US006913204B1

(12) United States Patent
Bradford

(10) Patent No.: US 6,913,204 B1
(45) Date of Patent: Jul. 5, 2005

(54) PREFABRICATED WATERFALL ASSEMBLY

(75) Inventor: Chris A. Bradford, 1701 Hillcrest Dr., North Manchester, IN (US) 46962

(73) Assignee: Chris A. Bradford, North Manchester, IN (US)

( * ) Notice: Subject to any disclaimer, the term of this patent is extended or adjusted under 35 U.S.C. 154(b) by 0 days.

(21) Appl. No.: 10/641,555

(22) Filed: Aug. 15, 2003

(51) Int. Cl.[7] ..... B05B 17/08
(52) U.S. Cl. ..... 239/17; 239/22; 239/23; 239/211
(58) Field of Search ..... 239/17, 16, 18, 239/20, 22, 23, 211

(56) References Cited

U.S. PATENT DOCUMENTS

| | | | | |
|---|---|---|---|---|
| 353,862 | A * | 12/1886 | Johnson | 40/407 |
| 446,897 | A * | 2/1891 | Smith | 239/17 |
| 917,459 | A * | 4/1909 | Kroenung | 239/17 |
| 1,689,790 | A * | 10/1928 | Lefevre, Jr. | 434/388 |
| 4,094,464 | A | 6/1978 | Kawamura et al. | 239/17 |
| 5,092,312 | A * | 3/1992 | Zolow | 126/500 |
| 6,176,027 | B1 | 1/2001 | Blount | 40/406 |
| 6,367,100 | B2 | 4/2002 | Koren et al. | 4/507 |
| 6,382,520 | B1 | 5/2002 | Hones | 239/12 |
| 6,405,937 | B1 | 6/2002 | Stukenberg | 239/12 |
| 6,439,471 | B2 * | 8/2002 | Ehrlich et al. | 239/18 |

FOREIGN PATENT DOCUMENTS

| | | | |
|---|---|---|---|
| FR | 27 10 110 | 3/1995 | F03B 13/08 |
| GB | 2 185 541 | 7/1987 | B05B 17/08 |
| GB | 2 256 157 | 2/1992 | D01D 35/02 |

* cited by examiner

*Primary Examiner*—Steven J. Ganey
(74) *Attorney, Agent, or Firm*—Taylor & Aust, P.C.

(57) ABSTRACT

A waterfall system includes a water reservoir; and a waterfall assembly adjacent the water reservoir. The waterfall assembly includes a frame with a plurality of metal structural members connected together to define a hollow interior. At least one discharge nozzle is carried by and directed away from the frame. A plurality of facia members are coupled to an exterior of the frame. The facia members cover the frame but do not cover the at least one discharge nozzle.

20 Claims, 4 Drawing Sheets

PREFABRICATED WATERFALL ASSEMBLY

BACKGROUND OF THE INVENTION

1. Field of the Invention

The present invention relates to waterfalls, and, more particularly, to waterfalls used with swimming pools and ornamental ponds.

2. Description of the Related Art

Waterfalls are a source of relaxation and beauty. They are sometimes incorporated into landscaping designs, particularly around swimming pools and garden areas. Construction of the waterfall may use natural building materials in an effort to duplicate a natural appearance. Alternatively, other types of building materials such as tile, verneer stones, stucco, brick, concrete, masonry products, etc. may be used, depending upon the type of appearance and mood which is desired.

A commercial installer of waterfalls tries to build the waterfall in a manner that is most appealing to the purchaser, and at minimal cost. Typically, a waterfall must be built from scratch at the job site. This requires that the installer use concrete blocks or rocks requiring a foundation as the base of a waterfall. Alternatively, a wood frame may be constructed at the job site depending upon the desires of the purchaser. These types of construction techniques do not lend themselves to repeatability, and are time consuming and expensive.

What is needed in the art is a waterfall assembly which can be easily and inexpensively installed at a job site, with improved consistency, reliability and aesthetics.

SUMMARY OF THE INVENTION

The present invention provides a waterfall assembly with a prefabricated frame ready for easy installation at a job site, which structurally supports the discharge nozzles and facia members, and houses the plumbing and possibly the water pump and lighting fixtures based on location/national codes.

The invention comprises, in one form thereof, a waterfall system including a water reservoir; and a waterfall assembly adjacent the water reservoir. The waterfall assembly includes a frame with a plurality of metal structural members connected together to define a hollow interior. At least one discharge nozzle is carried by and directed away from the frame. A plurality of facia members are coupled to an exterior of the frame. The facia members cover the frame but do not cover the at least one discharge nozzle.

The invention comprises, in another form thereof, a method of constructing a waterfall, including the steps of: providing a waterfall assembly, including a frame with a plurality of metal structural members connected together to define a hollow interior, and at least one discharge nozzle carried by and directed away from the frame; positioning the waterfall assembly adjacent a water reservoir; fluidly connecting a water pump between the discharge nozzle and the water reservoir; and attaching a plurality of facia members to an exterior of the frame, such that the facia members cover the frame but do not cover the at least one discharge nozzle.

An advantage of the present invention is that the framework for the waterfall can be constructed as a prefabricated unit offsite, eliminating the need for expensive manual construction at the job site.

Another advantage is that the frame can be sized such that tile can be attached to the exterior of the frame with minimum tile cuts, thereby reducing installation time and improving aesthetics.

Yet another advantage is that the water pump and/or lighting source can be housed within the hollow interior of the frame.

BRIEF DESCRIPTION OF THE DRAWINGS

The above-mentioned and other features and advantages, of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
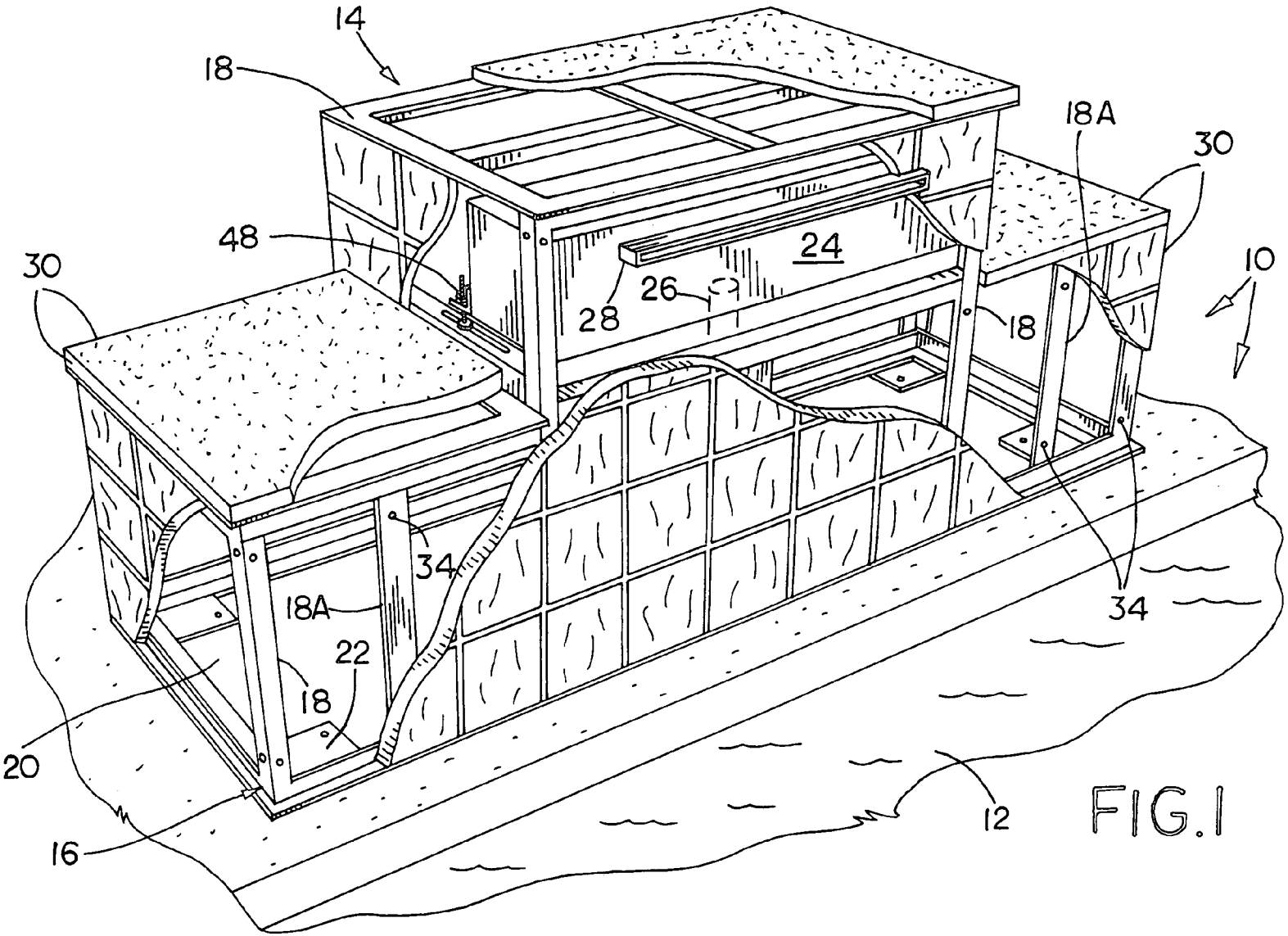
FIG. 1 is a perspective, front view of an embodiment of a waterfall system of the present invention.
Figure 2:
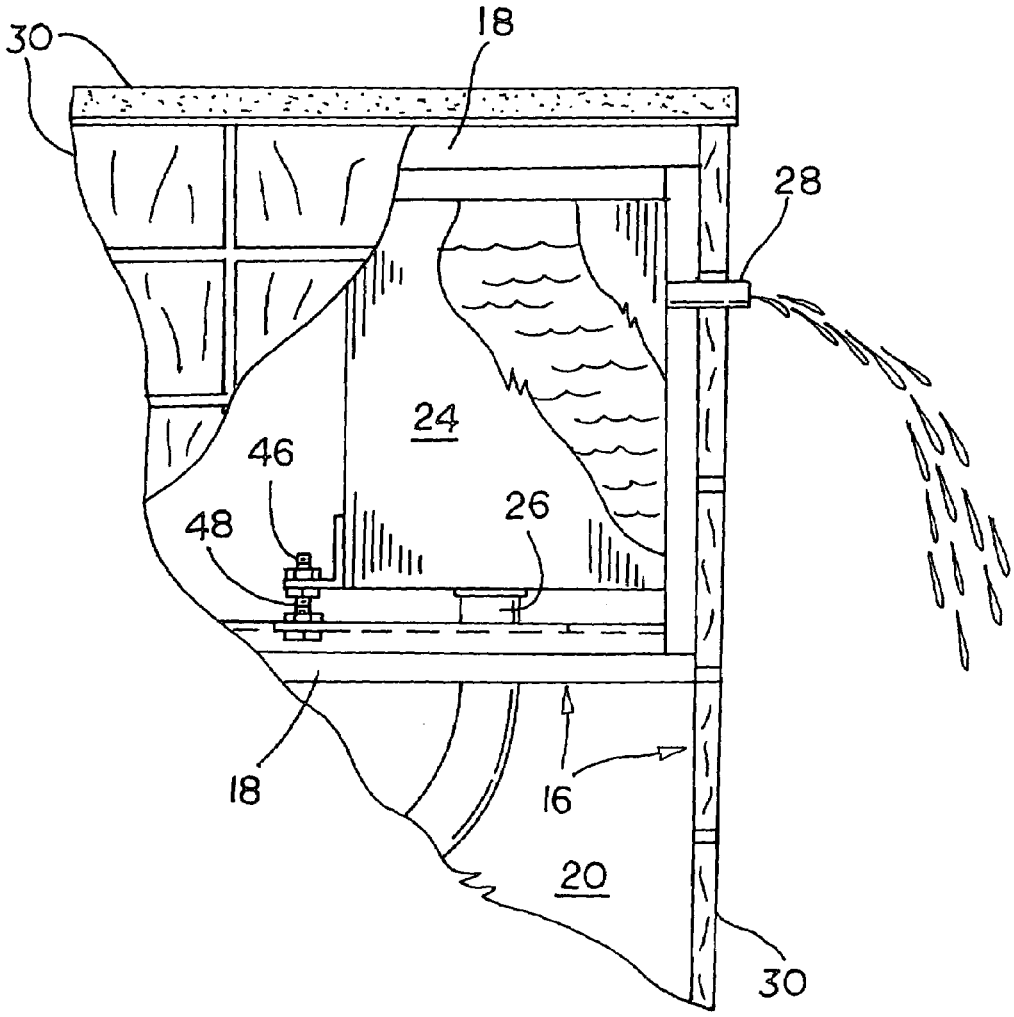
FIG. 2 is a side, sectional view illustrating the plenum arrangement at the front of the waterfall assembly.
Figure 3:
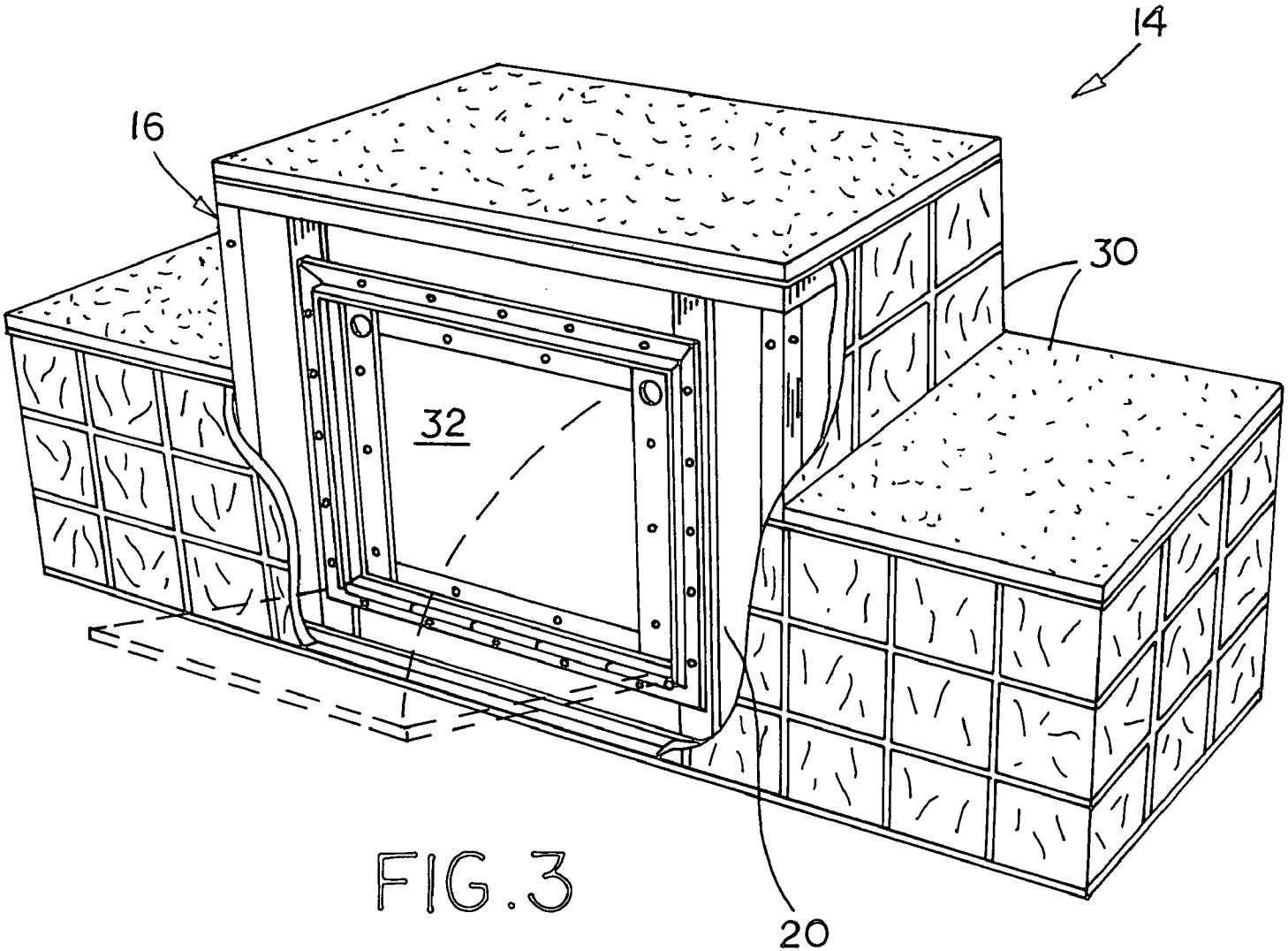
FIG. 3 is a perspective, rear view of the waterfall assembly shown in FIGS. 1 and 2.

Referring now to the drawings, there is shown an embodiment of a waterfall system 10 of the present invention, which generally includes a water reservoir 12 and a waterfall assembly 14 adjacent water reservoir 12. In the embodiment shown in FIGS. 1–3, water reservoir 12 is in the form of a swimming pool. In the embodiment shown in FIG. 4, water reservoir 12 is in the form of an ornamental pond.

Waterfall assembly 14 includes a frame 16 with a plurality of structural members 18 connected together to define a hollow interior 20. Structural members 18 are preferably formed from a corrosive resistant metal such as stainless steel or aluminum. Structural members 18 are metallurgically bonded to each other, such as by welding, but may also be fastened together using bolts, screws or the like. Structural members 18 have individual structural shapes depending upon the configuration, such as an angle iron, C-channel, strap, etc.

Hollow interior 20 allows access to mounting flanges 22 used to couple frame 16 with a fixed structure, such as a concrete deck adjacent a swimming pool. Hollow interior 20 also accommodates plumbing connections, etc. When waterfall assembly 14 is used in conjunction with a swimming pool, the pump from the swimming pool is typically used to recirculate a portion of the return water through waterfall assembly 14 prior to returning to the swimming pool. Alternatively, a dedicated pump may be positioned within hollow interior 20 of frame 16. Hollow interior 20 may also house a GFCI circuit, lighting circuit, etc.

A plenum 24 is coupled to an inside of frame 16 at a selected location, typically near the top of frame 16. Plenum 24 includes a water inlet 26 coupled with a fluid line, which in turn is coupled with a water pump. Plenum 24 also includes at least one discharge nozzle 28, which in the embodiment shown is in the form of a single slot-shaped nozzle. Plenum 24 may include other types of nozzles, such as tapered nozzles, diverging nozzles, sprinkler nozzles, straight nozzles, etc. Plenum 24 may include an internal baffle arrangement, and is dimensioned depending upon the application.

In the embodiment shown, plenum 24 is a model number 1202003-2' plenum manufactured by Jandy, having an address at P.O. Box 6000, Petaluma, Calif. 94955-6000. Another type of plenum that can be used is model number FFFF-24 or FFFWS-24 manufactured by Polaris, having an address at 2620 Commerce Way, Vista, Calif. 92083-8438. Other types of plenums are of course available and possible when used with waterfall assembly 14, depending upon the particular application.

Plenum 24 is coupled to frame 16 using an angle iron 46, which is adjustably mounted to frame 16 using a pair of threaded rods 48 at either end thereof. Threaded rods 48 may pass through respective threaded openings in angle iron 46, or may include a threaded nut on opposite sides of angle iron 46. Angle iron 46 is fastened to plenum 24, such as by using fasteners, and moves plenum 24 by using one or both of threaded rods 48. The portion of frame 16 to which threaded rods 48 are attached may also be configured with a slotted opening or a plurality of openings to accommodate different depth plenums. Thus, a single construction of frame 16 can accommodate different sized plenums, depending upon the application.

Frame 16 also includes an access door 32 which is preferably positioned at a rear of frame 16 for aesthetic purposes. Access door 32 may be hinged and latched in any suitable manner, or may simply be removable from frame 16.

A plurality of facia members 30 are coupled to an exterior of frame 16. Facia members 30 may be of any suitable building material selected by a purchaser, such as tile, stone, concrete and/or wood. Facia members 30 cover frame 16 but do not cover the one or more discharge nozzles 28.

The various faces of frame 16 are preferably sized to accommodate standard sizes and shapes of facia members, particularly tile. Tile is typically sold in 1 inch, 2 inch, 3 inch, 6 inch or 12 inch individual square pieces. The tile is placed on frame 16 in edge abutting relationship to each other, with a slight spacing between adjacent tile to accommodate grout. Structural members 18 of frame 16 are sized to receive standard size tiles with minimal tile cuts. Moreover, frame 16 includes a plurality of structural members 18*a* which are positioned to overlap adjacent edges of the tiles to thereby provide support along the edges of the tiles.

Depending upon the type of facia material used as well as the attaching or bonding technique used, frame 16 may also be provided with a plurality of holes 34 for mounting facia members 30 (or an intermediate backing board, not shown) to frame 16. For example, holes 34 may receive fasteners therein, or provide an increased surface area for an adhesive.

Figure 4:
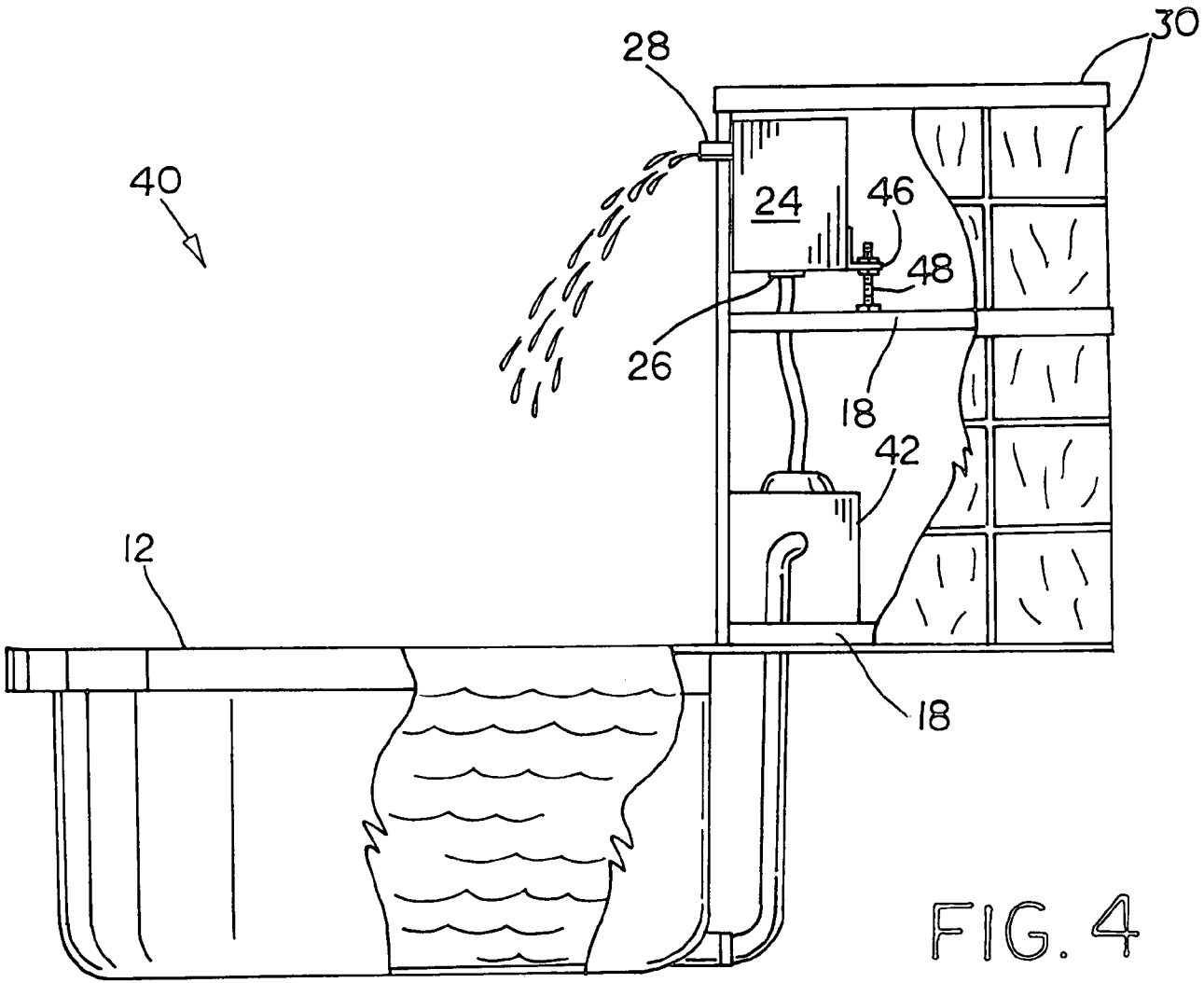
FIG. 4 is a side, partially fragmentary view of another embodiment of a waterfall system of the present invention.

Referring now to FIG. 4, there is shown another embodiment of a waterfall system 40 of the present invention. The primary difference between waterfall system 40 and waterfall system 110 is that water reservoir 12 is an ornamental pond which is directly coupled with frame 16 of waterfall system 40. When configured in this manner as a stand-alone unit, waterfall system 40 also includes a water pump 42 within hollow interior 20 of frame 16. Otherwise, waterfall system 40 is similar to waterfall system 10 described above.

In the embodiments of waterfall systems 10 and 40 described above, a single unit is shown. However, it is to be understood that a number of individual waterfall assemblies may be positioned in an end-to-end relationship relative to each other to present a longer waterfall system. Additionally, each waterfall assembly is shown above with a generally rectangular configuration as viewed from the top. However, it is to be understood that each waterfall assembly may have any desired exterior shape. For example, the front and rear walls may be formed with a convex or concave shape, and the plenum similarly formed with a convex or concave shape. Such a convex or concave shaped waterfall assembly may then be used as a single unit or ganged together in an end-to-end series manner to define a long arcuate wall.

During construction, waterfall system 10 is positioned adjacent to water reservoir 12. When water reservoir 12 is a swimming pool, waterfall assembly 14 is bolted or otherwise fastened to the concrete deck surrounding the pool. When water reservoir 12 is an ornamental pond, frame 16 is bolted to or at least positioned closely adjacent to the ornamental pond. Plenum 24 including at least one discharge nozzle 28 is coupled with a water pump (either the swimming pool pump or a dedicated pump) using appropriate fluid lines coupled with the discharge side of the pump. The inlet side of the pump is fluidly coupled with water reservoir 12. When a standalone pump is utilized, it is preferably placed within hollow interior 20 of frame 16. A plurality of facia members, such as tile, stone, concrete and/or wood are fastened to the perimeter of frame 16 using adhesives, fasteners, concrete or other suitable fastening techniques. The pump is energized to circulate water through waterfall system 10, 40 and discharge the water from discharge nozzle 28 into water reservoir 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A waterfall assembly, comprising:

a frame including a plurality of metal structural members connected together to define a hollow interior;

at least one substantially horizontal discharge nozzle carried by and directed away from said frame; and a plurality of facia members coupled to an exterior of said frame, said facia members covering said frame but not covering said at least one discharge nozzle.

2. The waterfall assembly of claim 1, further including a plenum coupled to an inside of said frame, said plenum including a water inlet within said hollow interior, and including at least one said discharge nozzle.

3. The waterfall assembly of claim 2, wherein said plenum is adjustably mounted to said frame.

4. The waterfall assembly of claim 1, wherein said at least one discharge nozzle includes a single slot-shaped nozzle.

5. The waterfall assembly of claim 1, wherein said facia members include at least one of tile, stone, concrete and wood.

6. The waterfall assembly of claim 1, wherein said facia members include a plurality of tile positioned in edge abutting relationship to each other, and said frame includes a plurality of structural members positioned to overlap adjacent edges of said tile.

7. The waterfall assembly of claim 1, wherein said frame includes a plurality of holes for mounting said facia members.

8. The waterfall assembly of claim 1, wherein said frame includes an access door.

9. The waterfall assembly of claim 8, wherein said discharge nozzle is located at a front of said frame, and said access door is located at a rear of said frame.

10. The waterfall assembly of claim 1, further including a water pump positioned within said hollow interior.

11. The waterfall assembly of claim 1, further including a water reservoir directly coupled to said frame and positioned adjacent said at least one discharge nozzle.

12. A waterfall system, comprising:

a water reservoir being one of a swimming pool and an ornamental pond; and a waterfall assembly adjacent said water reservoir, comprising:

a frame including a plurality of metal structural members connected together to define a hollow interior;

at least one discharge nozzle carried by and directed away from said frame; and a plurality of facia members coupled to an exterior of said frame, said facia members covering said frame but not covering said at least one discharge nozzle.

13. The waterfall system of claim 11, further including a plenum coupled to an inside of said frame, said plenum including a water inlet within said hollow interior, and including said at least one discharge nozzle.

14. The waterfall assembly of claim 13, wherein said plenum is adjustably mounted to said frame.

15. The waterfall system of claim 12, wherein said facia members include at least one of tile, stone, concrete, wood, stucco, veneer stone and masonry products.

16. The waterfall system of claim 12, wherein said facia members include a plurality of tile positioned in edge abutting relationship to each other, and said frame includes a plurality of structural members positioned to overlap adjacent edges of said tile.

17. The waterfall system of claim 12, wherein said frame includes an access door.

18. The waterfall system of claim 17, wherein said discharge nozzle is located at a front of said frame, and said access door is located at a rear of said frame.

19. The waterfall system of claim 12, further including a water pump positioned within said hollow interior.

20. A method of constructing a waterfall, comprising the steps of:

providing a waterfall assembly, including a frame with a plurality of metal structural members connected together to define a hollow interior, and at least one discharge nozzle carried by and directed away from said frame;

positioning said waterfall assembly adjacent a water reservoir, said water reservoir being one of a swimming pool and an ornamental pond;

fluidly connecting a water pump between said discharge nozzle and said water reservoir;

attaching a plurality of facia members to an exterior of said frame, such that said facia members cover said frame but do not cover said at least one discharge nozzle.

* * * * *